United States Patent [19]

Celest

[11] Patent Number: 4,967,935

[45] Date of Patent: Nov. 6, 1990

[54] ELECTRONICALLY CONTROLLED FLUID DISPENSER

[76] Inventor: Salvatore A. Celest, 24 Elmwood Cir., Peabody, Mass. 01960

[21] Appl. No.: 351,936

[22] Filed: May 15, 1989

[51] Int. Cl.[5] ..... B67D 5/08; A47K 3/22

[52] U.S. Cl. ..... 222/63; 222/642; 222/181; 222/321; 222/333; 4/605

[58] Field of Search ..... 222/54, 63, 383, 321, 222/180, 181, 183, 185, 175, 333, 643, 642; 417/552, 553, 554; 4/605, 623; 239/332

[56] References Cited

U.S. PATENT DOCUMENTS

| | | | |
|---|---|---|---|
| 3,419,188 | 12/1968 | Matchett | 222/52 |
| 3,639,920 | 2/1972 | Griffin et al. | 4/623 |
| 3,650,435 | 3/1972 | Kleefeld | 222/52 |
| 4,606,085 | 8/1986 | Davies | 4/623 |
| 4,645,094 | 2/1987 | Acklin et al. | 222/52 |
| 4,722,372 | 2/1988 | Hoffman et al. | 222/52 X |
| 4,735,357 | 4/1988 | Gregory et al. | 4/623 X |

FOREIGN PATENT DOCUMENTS

| | | | |
|---|---|---|---|
| 2644151 | 4/1978 | Fed. Rep. of Germany | 222/642 |
| 1426583 | 3/1976 | United Kingdom | 222/648 |

OTHER PUBLICATIONS

"Beyond the Basics", Brochure by Sloan Valve Co., Eng. News Record, Jun. 9, 1983.

*Primary Examiner*—Andres Kashnikow
*Assistant Examiner*—Gregory L. Huson

[57] ABSTRACT

An electronically-controlled fluid dispenser which houses a replaceable self-venting, self-priming plump and fluid container and contains a rotary motor for automatically operating the pump in response to an optically-detected infrared signal. The infrared signal is generated with a predetermined waveform which is detectable by a receiver so as to avoid extraneous signals. The rotary motor operates the pump through an eccentric cam directly mounted upon the pump dispensing plunger to cause direct linear motion. The dispenser is designed for battery operation.

8 Claims, 5 Drawing Sheets

ELECTRONICALLY CONTROLLED FLUID DISPENSER

FIELD OF THE INVENTION

This invention relates to electronically-controlled fluid dispensers, particularly for dispensing soap for clinical application, and more particularly to an electronically-controlled fluid dispenser which is aseptic in operation, self-venting and responsive to an infrared reflected signal of predetermined configuration.

BACKGROUND OF THE INVENTION

Mechanical fluid dispensers require the user to actuate the pumping mechanism by hand or foot. Operation by hand is not considered very sanitary and is undesirable for use in medical and dental facilities. The foot-actuated fluid dispenser is an unwieldly assembly which is cumbersome to use, bulky and expensive. Accordingly, a need exists for an inexpensive, compact and relatively small electronically-controlled fluid dispenser for universal clinical application in medical and dental facilities, as well as industrial and commercial institutions.

Electronically-controlled fluid dispensers are not new and to a limited degree are presently commercially available. The commercially available dispenser is an elaborate fluid pumping system containing a pump specifically designed for this purpose and a solenoid-controlled electromechanical assembly for operating the pump in response to an optically-detected signal. A solenoid consumes a substantial amount of power and accordingly must be powered by alternating current from a source of conventional AC power. The solenoid is actuated by a photodetection arrangement involving the interruption of a beam of light or the detection of irradiated energy within a prescribed bandwidth. The latter mechanism of photodetection is very susceptible to extraneous light. To avoid false operation, the detection system is sensitized to the reflected signal simply by requiring the user or the user's hands to be positioned very close to the light source to function. Also, the pumping sequence and mode of operation requires considerable electrical power to discharge the desired dosage of fluid. Accordingly, such dispensers are, by their nature, large, bulky units which are far more costly than their mechanical counterparts.

The electronic dispenser of the present invention has been designed to operate at very low power, either from a battery with very little power drain or from a conventional AC source of power. The system utilizes a rotary motor integrated in an assembly with a self-priming, self-venting pump and a conventional container for storing the fluid to be dispensed. The motor is controllably actuated by an electronic control circuit which uses a photodetection circuit designed to respond only to a reflected infrared signal of predetermined configuration. By integrating a motor drive with a conventional, mechanically-operated, self-priming pump, the system cost is reduced to a fraction of the cost of the commercially available electronically-controlled fluid dispensers. In addition, by generating a light pulse of predetermined waveshape, controlled detection is simplified without concern of extraneous light. The simplicity of the system is its unique attribute.

SUMMARY OF THE INVENTION

The electronically-controlled fluid dispensing system of the present invention comprises:

a housing for a flexible container in which the fluid to be dispensed is stored;

a self-priming pump having a pump head and spout attached to said container for discharging fluid from said container through said spout upon depression of said pump head;

a rotary motor having a rotatable output drive shaft;

a cam eccentrically mounted upon said output drive shaft with said cam juxtaposed in physical contact against said pump head; and an electrical control drive circuit for operating said rotary motor over a short, predetermined time interval upon detection of an optical signal of predetermined waveshape, with said drive circuit including means for emitting an optical signal of short duration with a predetermined wavelength in the infrared spectrum and of a predetermined configuration, optical detection means simultaneously responsive to the wavelength and configuration of said optical signal, means responsive to actuation of said optical detection means for generating a timed control signal, and means for applying power to said rotary motor in response to said timed control signal.

DESCRIPTION OF THE PREFERRED EMBODIMENT OF THE INVENTION

Figure 1:
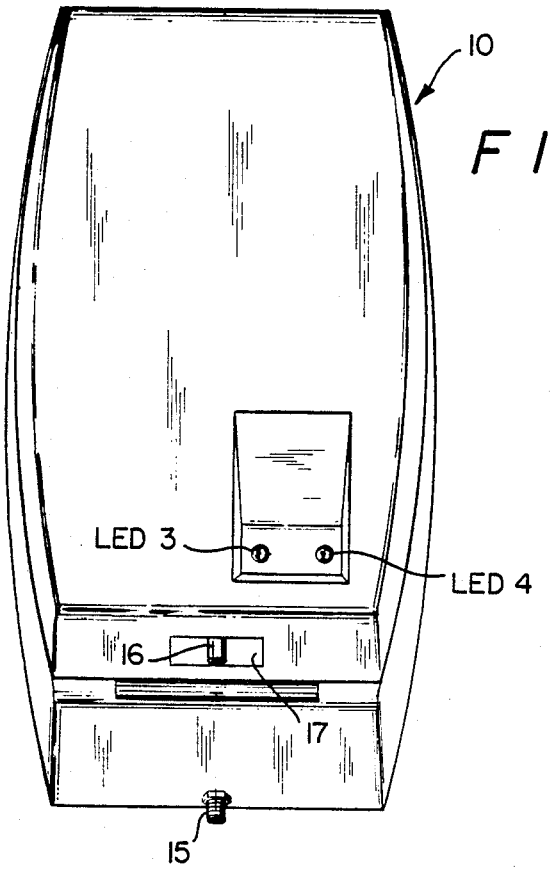
FIG. 1 is a front elevation of the electronically-controlled fluid dispensing system of the present invention.
Figure 2:
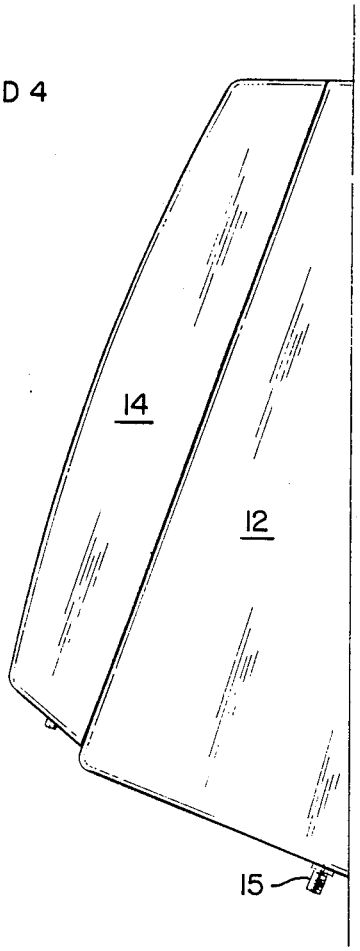
FIG. 2 is a side elevation of the fluid dispenser of FIG. 1, adapted for mounting on a wall.
Figure 3:
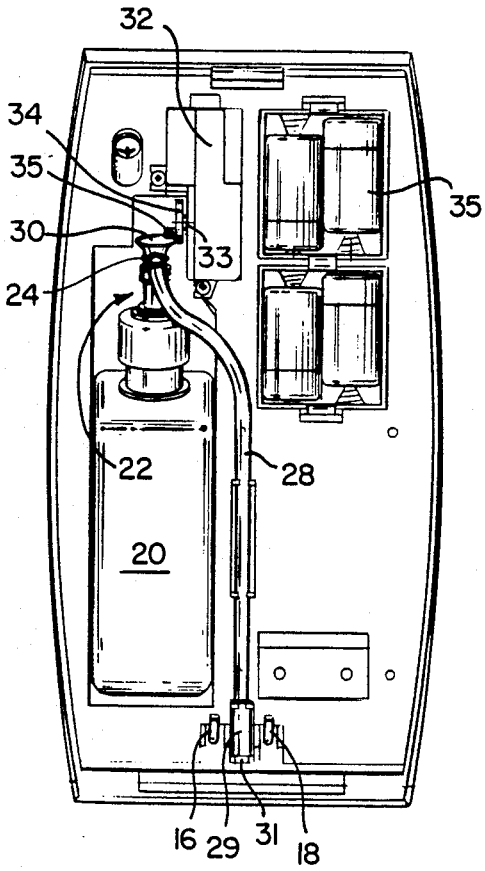
FIG. 3 is a front elevation, similar to FIG. 1, with the cover of the dispenser removed.
Figure 4:
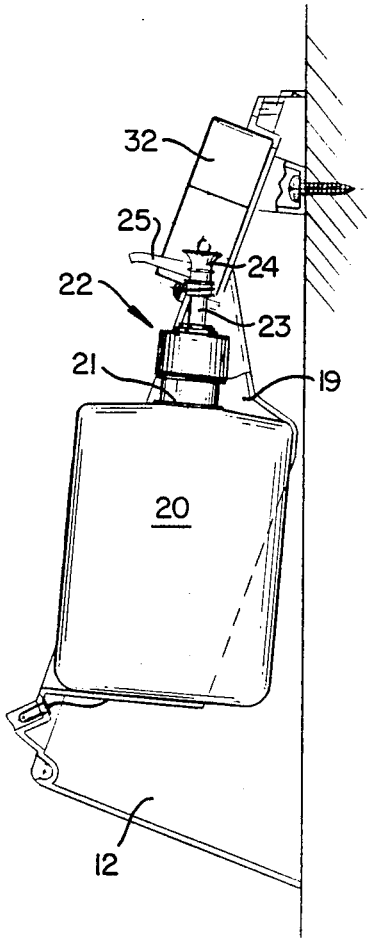
FIG. 4 is a cross-sectional view of FIG. 3, taken along the lines 4—4 of FIG. 3.
Figure 5:
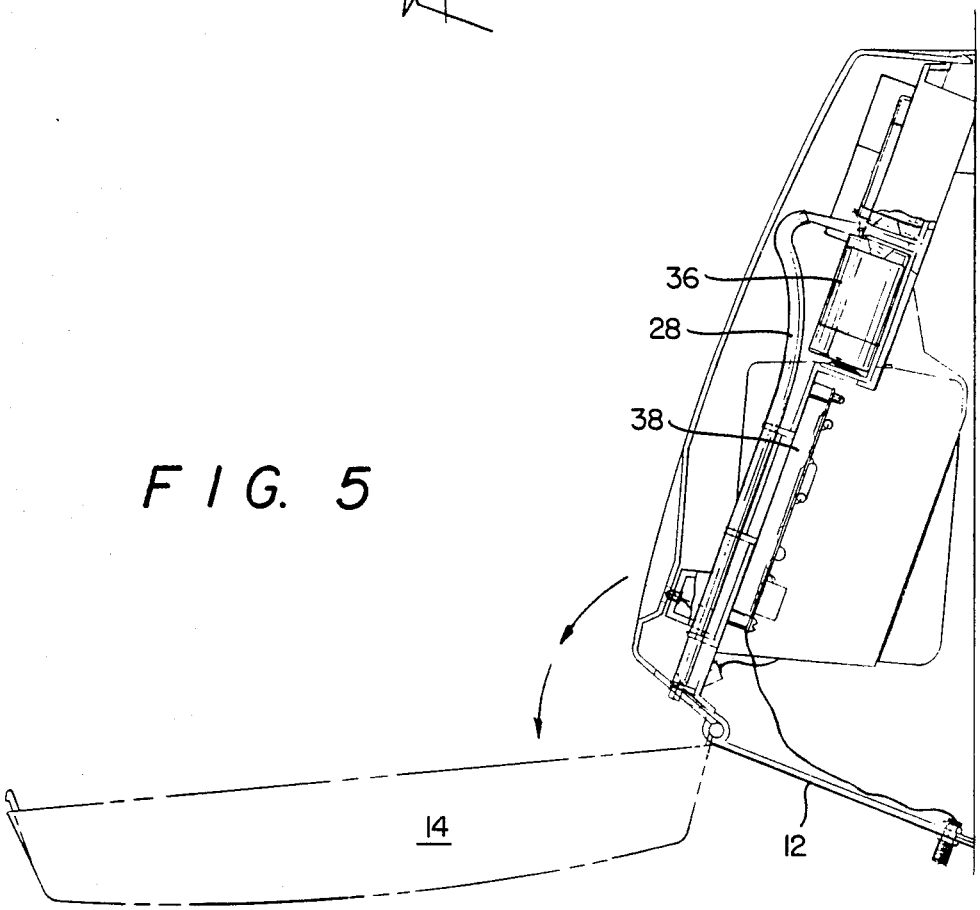
FIG. 5 is another cross-sectional view of FIG. 3, taken along the lines 5—5 of FIG. 3.

The fluid dispenser of the present invention, is identified by the reference number "10" and, as is shown in FIGS. 1 and 2, is a relatively small, lightweight, self-contained unit having a body (12) adapted for wall-mounting and a removable cover (14) hinged to the body (12). The fluid dispenser (10) may be connected through an electrical connector (15) to a conventional AC source of power. An infrared light emitting diode (LED) (16), as shown in FIGS. 3–5, extends through a slot (17) in the cover (14) for transmitting a pulse of infrared energy at predetermined time intervals, as will hereinafter be explained at greater length. A corresponding photoreceiver (18) is mounted in the slot (17) alongside the photo-emitter (16).

A fluid container (20) is removably mounted in a compartment (19) in the body (12) of the dispenser (10). The container (20) may be filled with any desired fluid medium to be discharged through the dispenser, preferably a disinfecting soap. The container (20) is mounted with the top end (21) standing upright in the body (12). A conventional, self-priming pump (22) is affixed to the top end (21) of the container (20). The pump (22) is of conventional design, having a plunger (23) extending from a vented pump head (24), through an internal check valve (not shown). The pump is actuated by depressing the pump head (24) which depresses the plunger (23) for discharging fluid from the container (20) through the spout (25) extending from the pump head (24). The volume of fluid discharged from the pump (22) on the downstroke cycle is replenished with a corresponding volume of air sucked into the container (20) through the internal pump check valve (not shown) in the vented pump head (24). The pump head (24) is spring-loaded so that the head (24) returns to its normal undepressed or primed position when it is released. The container (20) is preferably a flexible plastic bottle which may expand and contract to assist the pumping action. The pump (22) is a conventional positive displacement pump with an internal ball check valve to permit venting through the pump head (24) from the immediate atmosphere surrounding the container (20) internal of the body (12) of the fluid dispenser (10).

The spout (25) is connected through tubing (28) which passes through a conventional one-way check valve (29) located at the discharge end (30) of the tubing (28). Fluid may be discharged through the check valve (29) in only one direction. Accordingly, the check valve (29) prevents the reverse flow of fluid through the tubing (28) on the upstroke of the plunger (23) The check valve (29) operates in concert with the self-priming pump (22) to prevent contamination of the container (20) which cannot be compromised by conditions external of the dispenser (10). This assures aseptic operation. The one-way check valve (29) is conveniently mounted between the photo-emitter (16) and photoreceiver (18) to partition each from the other. However, an alternative arrangement is to insert the photo-emitter (16) and photodetector (18) in separate cylindrical tubes which isolates them. In this way, the only way light may be detected is by a reflected signal passing through the tube surrounding the photodetector (18).

Figure 7:
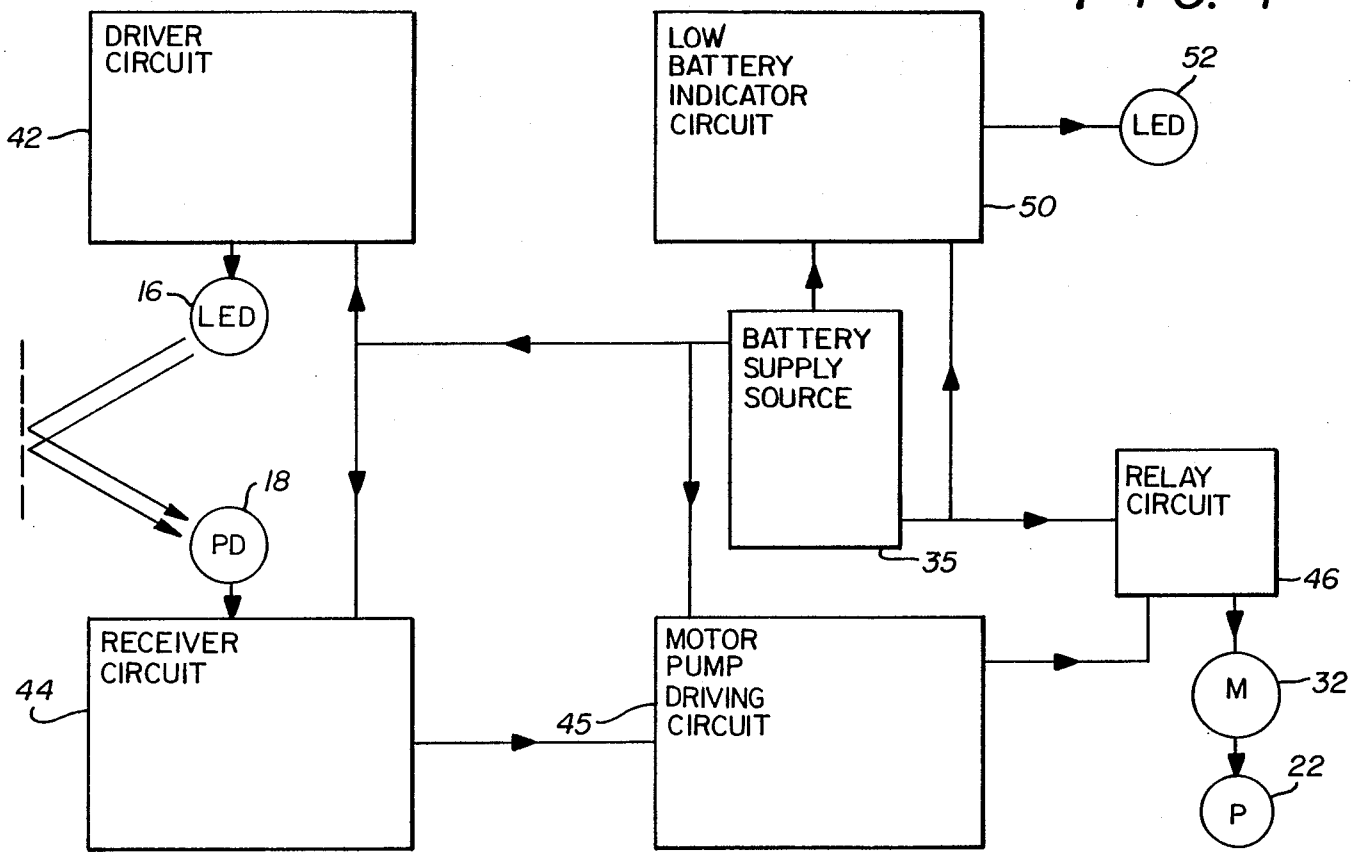
FIG. 7 is a block diagram of the system operation for the fluid dispenser of FIG. 1.
Figures 8, 9:
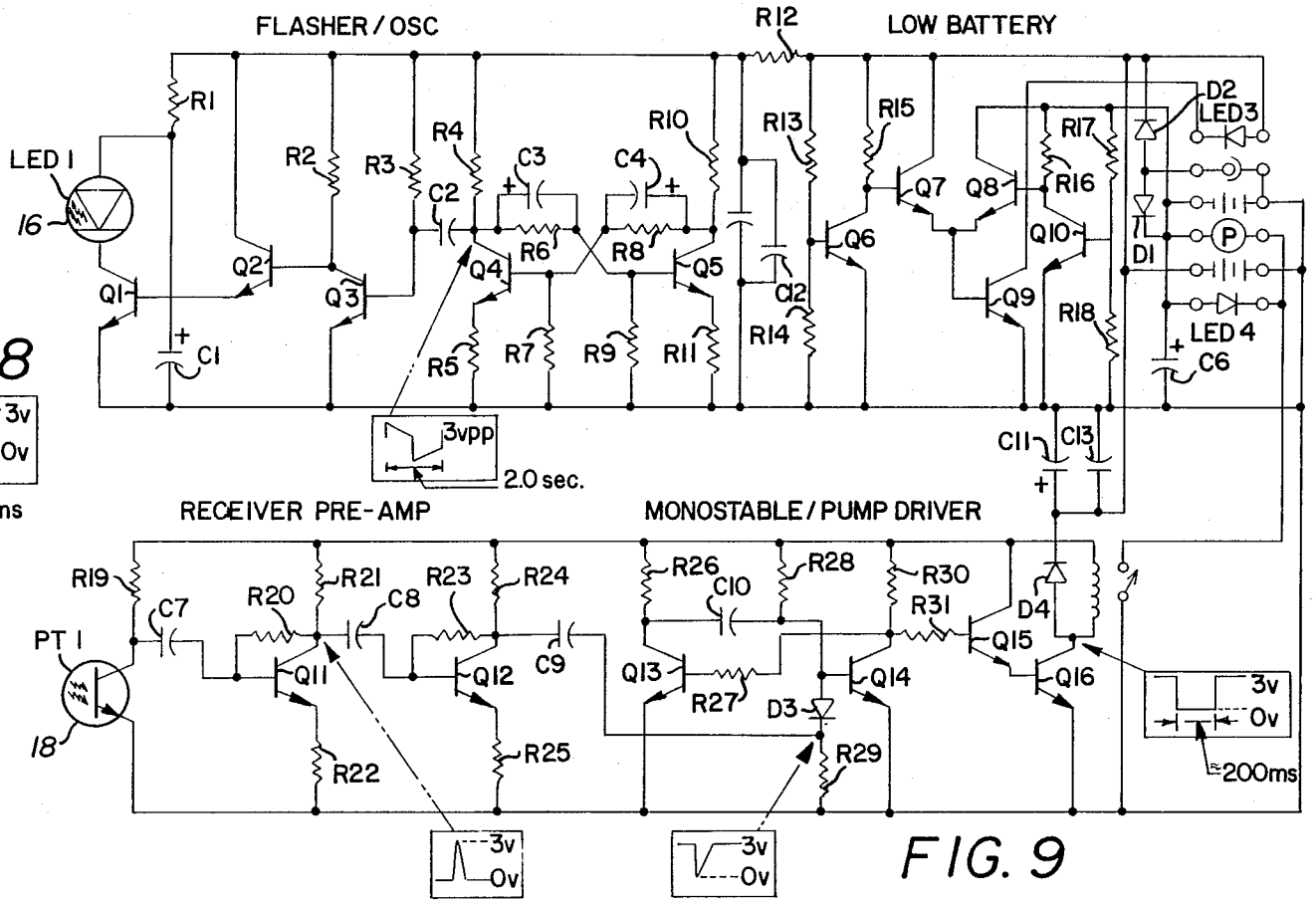
FIG. 8 is the preferred waveshape for the transmitted energy pulse from the photo-emitter of FIG. 7.
FIG. 9 is the electrical schematic for the block diagram of FIG. 7.

The pump head (24) has a concave depression (30) giving it a "saddle-like" geometry. The container (20) and pump (22) may preferably represent a commercially available mechanically-operated fluid dispenser. This minimizes manufacturing cost and permits the use of interchangeable dispensers. It also preserves sanitary operation of the container (20) in that the pump (22) and container (20) may be readily replaced as one unit. In accordance with the present invention, the pump head (24) is driven electromechanically under the control of an electronic infrared control and sensor circuit, as illustrated in FIGS. 7 and 9.

Figure 6:
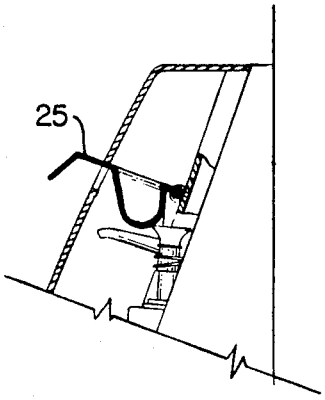
FIG. 6 is a partial view in cross section of an alternate embodiment of the invention.

A rotary motor (32) preferably a DC motor, is mounted in the body (12) of the fluid dispenser (10). The rotary motor (32) has a rotatable shaft (33) which has an eccentric cam (34) affixed thereto. The eccentric cam (34) is positioned with the cam shaft (35) in direct contact with the pump head (24), and preferably resting on the "saddle-like" concave surface (30). As the shaft (33) rotates, the cam shaft (35) rides on the concave surface (30), providing automatically-controlled linear reciprocating movement of the pump head (24) which, in essence, simulates mechanical depression of the pump head (24). The rotary motor (32) is operated from batteries (35) under the control of the electronic infrared control and sensor circuit of FIGS. 7 and 9. FIG. 6 is an alternate embodiment or accessory for mechanically depressing the pump head (24) through the lever (25).

The electronic control circuitry for the fluid dispenser (10) is mounted on a circuit board (38) removably inserted into the body (12) of the dispenser (10). A short burst or pulse of infrared energy is generated from the photo emitter (16) by the driver circuit (42). The driver circuit (42) causes the pulse of energy to be of a predetermined waveshape, as shown in FIG. 8, having a fast rise time. Power is supplied to the photo-emitter (16) and driver circuit (42) by a battery (36). The photodetector "PD" (18) is selectively responsive to the infrared pulse generated by the emitter (16) and through a receiver circuit (44) is simultaneously responsive to the waveshape configuration of the infrared pulse for actuating the motor pump driving circuit (46). The motor pump driving circuit (45) generates a timed signal which actuates a relay circuit (45) which, in turn, controls the supply of power to the rotary motor (32).

The rotary motor (32) is operated for a controlled time period corresponding to the duration of the timed signal generated by the motor pump driving circuit (44). The motor (32) operates the pump (22) as heretofore explained. Power to the motor (32) is applied from a battery source (35) or from an AC source of power (not shown). A low battery circuit (50) operates a low battery LED (52) and an LED dispenser light (53). Actuation of LED (52) provides a visible indication for replacing the control batteries (36) when they have been substantially fully discharged. An LED dispenser light (53) is actuated during the time interval the motor (32) is operational, which provides a visual indication of satisfactory electronic performance and as an indicator of the supply of soap in the container (20).

The preferred circuitry for the block diagram of FIG. 7 is shown in FIG. 9. The LED emitter (16) is connected in the driver circuit (42) which consists of transistors Q1, Q2, and Q3, respectively. The driver circuit (42) is, in turn, driven by an oscillator (43) consisting of an astable multivibrator formed from transistors Q4 and Q5, in combination with resistors R4 through R11, and capacitors C3 and C4. The oscillator (43) has a frequency of 0.5 Hz and is coupled through capacitor C2 to the driver circuit (42) This causes the emitter (16) to pulse (flash) once every few seconds. The pulse width is designed to be approximately 1 millisecond, with a sharp (very fast rise time) leading edge (47). The duty cycle for the operation of the emitter (16) is held to a small percentage, preferably only one percent (1%). Accordingly, very little power is consumed in providing the generated light pulses.

The infrared detector (18) is connected to the receiving circuit (44) which consists of transistor Q11, which operates only in response to a detected pulse with a fast rise time leading edge (47). A properly detected pulse causes a sufficient increase in photocurrent through the detector (18) drawn from the base (48) of transistor Q11, which causes transistor Q11 to momentarily turn off. This produces a pulse at collector (49) which is amplified by transistor Q12 and fed via capacitor C9 into the pump driving circuit (45). The pump driving circuit (45) consists of a monostable multivibrator circuit formed from transistors Q13 and Q14 and resistors R26 through R30. When the pump driving circuit (45) is triggered, it produces a timing pulse of predetermined duration. The timing pulse energizes the relay (50) to close the relay contacts (52) for supplying power from the batter (35) to operate the motor (32). The motor (32) is operated for a time period corresponding to the duration of the timing pulse.

The low battery circuit (50) consists of resistors R13 and R14 and transistors Q6, Q7, Q8, Q9 and Q10. Resistors R13 and R14 form a voltage divider circuit to monitor the voltage of the control battery (36). When the voltage of battery (36) drops to approximately 2.5 volts, the drop across resistor R14 is insufficient to forward bias the base-emitter junction of transistor Q6. This causes transistor Q6 to turn off, which causes its connector junction (60) to rise to battery voltage, turning on transistor Q9 via transistor Q7. Transistor Q9, when turned on, causes LED (52) to actuate, indicating a low-battery condition for battery (36). An identical circuit operation is provided for the pump battery (35) consisting of resistors R17 and R18, which form a voltage divider network and resistor R16 in conjunction with transistor Q10 and Q8.

What is claimed is:

1. An electronically-controlled fluid dispensing system comprising:

a housing;

a flexible container mounted in said housing for storing fluid to be dispensed from said housing;

a self-priming pump having a reciprocating pump head mounted upon said container and spout means for discharging fluid from said container upon depression of said pump head;

a rotary motor mounted in said housing and having a rotatable output drive shaft;

a cam eccentrically mounted upon said output drive shaft with said cam having a cam shaft juxtaposed in physical contact against said pump head; and an electrical control drive circuit for operating said rotary motor over a short, predetermined time interval upon detection of an optical signal of predetermined waveshape, with said drive circuit including means for emitting an optical signal external of said housing and of short duration with a predetermined wavelength in the infrared spectrum and circuit detector means for detecting an optical signal reflected back to said housing from an object placed in the path of said emitted signal, with said circuit detector means being responsive only to an optical signal in the infrared spectrum and only when said signal is of a predetermined configuration, means responsive to actuation of said circuit detector means for generating a timed control signal, and means for applying power to said rotary motor in response to said timed control signal.

2. An electronically-controlled fluid dispensing system, as defined in claim 1, wherein said container is mounted in said housing in an upright position, with said reciprocating pump head removably mounted on top of said container.

3. An electronically-controlled fluid dispensing system, as defined in claim 2, wherein said self-priming pump further comprises vent means for venting said container to the atmosphere, a plunger for reciprocating said pump head, and spring means for returning said pump head to an undepressed position upon releasing said pump head.

4. An electronically-controlled fluid dispensing system, as defined in claim 3, wherein said dispenser is powered from a plurality of batteries or from a source of conventional AC power.

5. An electronically-controlled fluid dispensing system, as defined in claim 4, wherein said spout means further comprises a spout connected to said pump head and a tube connected to said spout, with said tube having an open discharge end and a one-way check valve connected to said open discharge end to permit unidirectional discharge of fluid from said dispenser.

6. An electronically-controlled fluid dispensing system, as defined in claim 5, wherein said circuit detector means is responsive to a signal in the infrared spectrum of short duration, with a leading edge having a fast rise time.

7. An electronically-controlled fluid dispensing system, as defined in claim 6, wherein said drive circuit generates an electrical signal with a very low duty cycle.

8. An electronically-controlled fluid dispensing system, as defined in claim 7, wherein the duty cycle is one percent.

* * * * *